United States Patent [19]

Brandt et al.

[11] Patent Number: 4,765,791

[45] Date of Patent: Aug. 23, 1988

[54] APPARATUS FOR EXPELLING AIR FROM STACKS OF PAPER SHEETS AND THE LIKE

[75] Inventors: Eckhard Brandt, Norderstedt; Robert Deutschle, Bokholt-Hanredder, both of Fed. Rep. of Germany

[73] Assignee: E. C. H. Will GmbH & Co., Hamburg, Fed. Rep. of Germany

[21] Appl. No.: 921,943

[22] Filed: Oct. 20, 1986

[30] Foreign Application Priority Data

Nov. 13, 1985 [DE] Fed. Rep. of Germany ..... 3540203

[51] Int. Cl.[4] ..... B30B 9/00; B65G 47/22

[52] U.S. Cl. ..... 414/28; 100/156; 198/369; 271/105; 414/907

[58] Field of Search ..... 414/28, 907; 198/836, 198/369; 271/105; 100/144, 153, 156

[56] References Cited

U.S. PATENT DOCUMENTS 588,125 8/1897 Bundren ..... 100/156
3,515,056 6/1970 Johnson ..... 100/153 X
4,416,196 11/1983 Yamada et al. ..... 100/153 X
4,509,417 4/1985 Brandt et al. ..... 414/907 X
4,603,768 8/1986 Deutschle ..... 198/369

*Primary Examiner*—Leslie J. Paperner
*Attorney, Agent, or Firm*—Peter K. Kontler

[57] ABSTRACT

Two conveyors for stacks of paper sheets are coupled to each other for movement back and forth between a first position in which one of the conveyors receives one or more stacks and the other conveyor is relieved of the stack or stacks thereon, and a second position in which the one conveyor is relieved of the stack or stacks thereon and the other conveyor receives one or more stacks. In order to expel air from the stacks on the conveyors the foremost portions of the stacks are clamped by reciprocable rams to the respective conveyors and the thus clamped stacks are caused to move along stationary squeegees which bear against successive increments of the stacks behind the respective rams while the stacks, the respective rams and the respective conveyors move away from the stack-receiving positions.

13 Claims, 4 Drawing Sheets

APPARATUS FOR EXPELLING AIR FROM STACKS OF PAPER SHEETS AND THE LIKE

BACKGROUND OF THE INVENTION

The present invention relates to improvements in apparatus for manipulating stacks of overlapping paper sheets or the like, and more particularly to improvements in apparatus for transporting stacks between successive stations in production lines, e.g., in a production line for the making of exercise books, steno pads and analogous stationery products.

Commonly owned U.S. Pat. No. 4,603,768 granted Aug. 5, 1986 to Robert Deutschle for "Apparatus for transporting paper stacks" discloses a system of conveyors wherein two intermediate conveyors are coupled to each other for movement between positions of registry with discrete stack supplying conveyors and positions of alignment with a common stack receiving conveyor. The conveyors of the patented apparatus exhibit the advantage that they can treat the stacks gently and occupy a relatively small amount of space in spite of the fact that they can transport large numbers of stacks per unit of time. Gentle treatment of stacks is very important in many types of production lines because any, even negligible, shifting of certain sheets in a stack relative to the other sheets may prevent proper treatment of such stacks at the next-following station or stations, e.g., at a station where the sheets of a stack are to be provided with holes for reception of spiral binders or the like. Attempts to prevent misaligned sheets from interfering with satisfactory processing of the stacks include the provision of discrete aligning units at the stations which follow the conveyors. This contributes to the initial and maintenance cost of the production line and to space requirements of the stations.

Certain instability of stacks which are transported in a production line of the type disclosed in U.S. Pat. No. 4,603,768 is attributable to entrapment of some air between the sheets of the stacks, mainly during accumulation of sheets into stacks. As a rule, entrapped air will escape with time but the interval which is required for the escape of entrapped air is often too long, especially in a modern production line which must turn out large numbers of pads or like products per unit of time. In addition, it is normally desirable to place successive sheet- and stack-processing stations close or very close to each other as well as to operate the stack-transporting conveyors at an elevated speed. This even further reduces the likelihood of spontaneous expulsion or escape of air before a stack reaches that station where the bodies of entrapped air might interfere with predictable processing of the stacks and/or before the entrapped air causes a shifting of one or more sheets in the respective stack.

OBJECTS AND SUMMARY OF THE INVENTION

An object of the invention is to provide a novel and improved apparatus for manipulating stacks of paper sheets or the like wherein each stack can be treated to expel air which is entrapped between its sheets before the stack reaches the receiving conveyor or another stack processing unit.

Another object of the invention is to provide an apparatus wherein the expulsion of air from the spaces between the sheets of the stacks takes place automatically during transport of stacks from a supplying conveyor to a receiving conveyor.

A further object of the invention is to provide the apparatus with novel and improved clamping or hold-down means for the stacks on the conveyors.

An additional object of the invention is to provide the apparatus with novel and improved means for expelling air from moving stacks of superimposed paper sheets or the like.

Still another object of the invention is to provide a novel and improved method of expelling air from moving stacks of paper sheets or the like.

A further object of the invention is to provide an apparatus which can expel air from stacks each of which is supported by a discrete conveyor or from rows or other accumulations of several stacks on a common conveyor.

Another object of the invention is to provide an apparatus which can be rapidly converted from the treatment of stacks consisting of relatively small sheets to the treatment of stacks consisting of larger sheets or vice versa.

An additional object of the invention is to provide a novel and improved method of automatically expelling air (if any) from the spaces between neighboring sheets which form stacks of overlapping sheets in a production line for the making of pads, books and other types of stationery products.

A further object of the invention is to provide an apparatus which can be installed in existing production lines as a superior substitute for conventional stack manipulating apparatus.

Another object of the invention is to provide an apparatus which can be installed in a production line of the type disclosed in the commonly owned U.S. Pat. No. 4,603,768.

The invention is embodied in an apparatus for manipulating stacks or analogous accumulations of sheets (particularly paper sheets) wherein air is (or is likely to be) entrapped between the sheets. The apparatus comprises first and second conveyors which are movable, preferably as a unit, back and forth along a predetermined path between first positions in which the first conveyor is ready to receive at least one stack and the second conveyor is ready to be relieved of one or more stacks, and second positions in which the second conveyor is ready to receive at least one stack and the first conveyor is ready to be relieved of one or more stacks. The apparatus further comprises first and second clamping means for respectively urging portions of stacks against the first and second conveyors during movement of the conveyors from the first and second positions, respectively, and first and second air expelling means adjacent the path and serving to respectively expel air from stacks on the first and second conveyors during movement of the conveyors from the first and second positions, respectively. The first and second expelling means are respectively located behind the first and second clamping means as considered in the direction of movement of the first and second conveyors from the first and second positions, respectively.

The arrangement is preferably such that the first and second clamping means are movable with the corresponding conveyors and respectively comprise means (such as vertically reciprocable plungers or rams) for clamping a portion of the stack on the first conveyor at a location nearest to the second conveyor and for clamping a portion of the stack on the second conveyor at a location nearest to the first conveyor.

The apparatus further comprises a frame or housing. The conveyors and the clamping means are movable relative to the frame, and the expelling means are affixed to the frame during movement of the conveyors relative to the frame. Carrier means can be provided to share the movements of the conveyors, and the clamping means are mounted on such carrier means. The air expelling means can be mounted in or on stationary supporting means provided on or forming part of the frame.

The apparatus preferably further comprises first adjusting means for changing the position of at least one of the clamping means relative to the respective conveyor in the direction of movement of the conveyors along the path in order to enable the respective conveyor to transport smaller or larger stacks (i.e., stacks consisting of larger or smaller sheets), and second adjusting means for changing the position of at least one air expelling means with reference to the path. At least one of the adjusting means can comprise a transmission, e.g., a rack-and-pinion drive.

At least one of the clamping means can comprise at least one vertically or nearly vertically movable overhead plunger or ram and means (e.g., a fluid-operated motor) for moving the ram relative to the stack on the respective conveyor.

At least one of the expelling means can comprise a squeegee (e.g., a roller-shaped squeegee) and means for moving the squeegee up and down relative to the stack on the respective conveyor.

If at least one of the conveyors (e.g., the first conveyor) is arranged to carry a series of stacks which are disposed one behind the other to form a row extending transversely of the direction of movement of the respective conveyor from the first to the second position or vice versa, the corresponding clamping means preferably comprises a discrete clamping device for each of the row of stacks and the respective expelling means comprises a discrete air expelling device for each stack of the row. The clamping means which cooperates with the one conveyor can comprise common carrier means for the clamping devices and resilient means between the carrier means and each clamping device. The carrier means is preferably mounted in the frame in such a way that it shares the movements of the conveyors. The expelling means which cooperates with the one conveyor preferably comprises stationary supporting means for the expelling devices and resilient means between the supporting means and each expelling device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
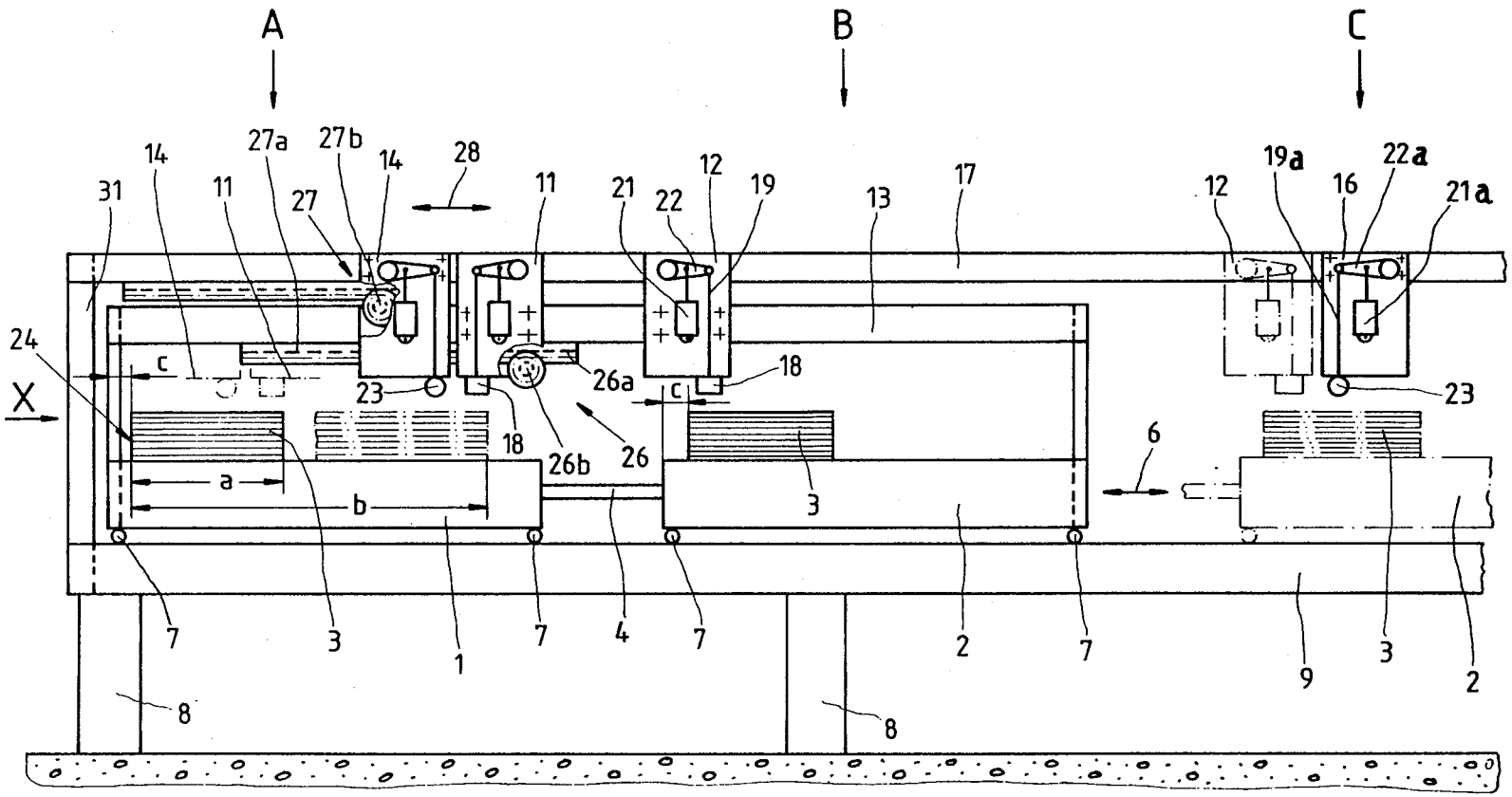
FIG. 1 is a rear elevational view of an apparatus which embodies one form of the invention.
Figure 2:
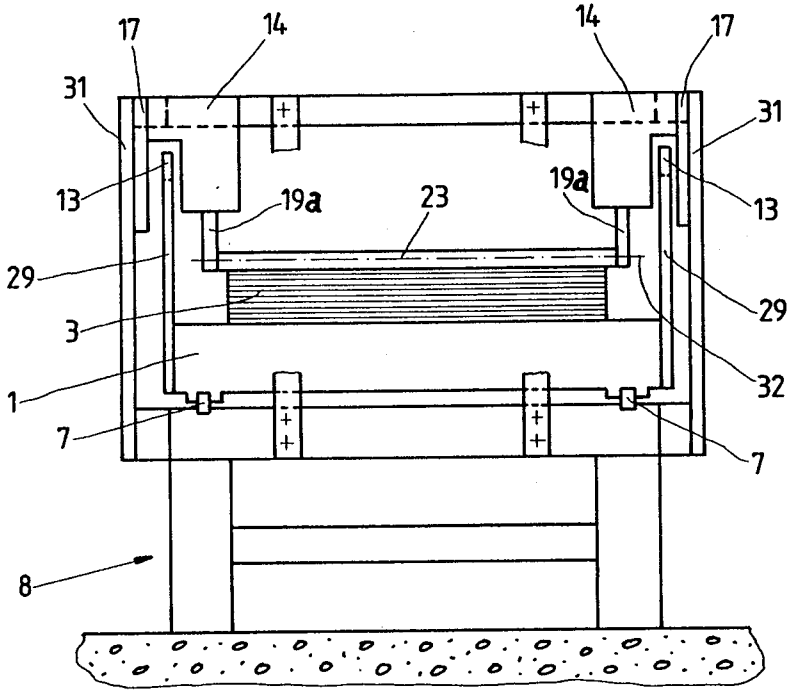
FIG. 2 is a side elevational view of the apparatus as seen in the direction of the arrow X in FIG. 1.

The apparatus of the present invention can be used in a production line of the type disclosed in U.S. Pat. No. 4,603,768 whose disclosure is incorporated herein by reference. In the embodiment of FIGS. 1 and 2, the apparatus comprises two conveyors 1 and 2 (corresponding to the conveyors 8, 9 in FIG. 1 of U.S. Pat. No. 4,603,768) which are separably or more or less permanently coupled to each other by a rod 4 or the like and are reciprocable, preferably as a unit, along an elongated path in directions which are indicated by a double-headed arrow 6. The conveyors 1 and 2 serve to support and advance stacks 3 of superimposed overlapping paper sheets or the like. When the conveyor 1 assumes the position A, the conveyor 2 assumes the position B, and the conveyor 1 assumes the position B when the conveyor 2 assumes the position C. When in the position A, the conveyor 1 is ready to receive a stack 3 from a supplying conveyor (corresponding to the conveyor 6 in FIG. 1 of U.S. Pat. No. 4,603,768) which delivers stacks at right angles to the plane of FIG. 1, and the conveyor 2 is ready to be relieved of its stack 3 when it assumes the position B (in which the conveyor 2 can move the stack at right angles to the plane of FIG. 1 and on to a stack receiving conveyor corresponding to the conveyor 12 in FIG. 1 of U.S. Pat. No. 4,603,768). The conveyor 2 is ready to receive a stack 3 from a second supplying conveyor when it assumes the position C, and the conveyor 1 (in the position B) is then ready to be relieved of its stack 3 by transferring or permitting the transfer of such stack onto the stack receiving conveyor. As shown in FIG. 1 by solid lines, the conveyor 1 is ready to receive (or has already received) a stack 3, and the conveyor 2 is ready to be relieved of its stack 3. The means for moving the conveyors 1 and 2 along their elongated path can comprise a rack and pinion drive, a reversible electric motor, a double-acting fluid-operated motor or any other suitable prime mover, not shown. When the conveyor 2 is ready to receive a fresh stack 3, it is held in the phantom-line position of FIG. 1, and the conveyor 1 then occupies the position which is close to that occupied by the conveyor 2 (as shown by solid lines) of FIG. 1.

Each of the conveyors 1 and 2 can comprise a platform or pallet mounted on wheels 7 which can travel along suitable rails (not specifically shown) on a horizontal frame member 9 secured to several upright frame members 8 which are mounted on or anchored in the ground. Each platform can be mounted on a set of four wheels 7.

The means for expelling air (if any) from the spaces between the sheets of the stacks 3 on the conveyors 1 and 2 is mounted in the frame including the frame members 8, 9 and is designed to expel air from the stack on the conveyor 1 while the latter moves from the position A to the position B, and to expel air from the stack 3 on the conveyor 2 while the latter moves from the position C to the position B. Such expelling means comprises a first expelling device 14 for the stack 3 on the conveyor 1, and a second expelling device 16 for the stack 3 on the conveyor 2. In order to prevent unintentional and uncontrolled stray movements of the sheets which form the stacks 3 on the conveyors 1 and 2, while the conveyor 1 moves from the first position (A) toward the second position (B) or while the conveyor 2 moves from the first position (C) toward the second position (B), the apparatus further comprises means for clamping the leading portions of the stacks 3 during treatment of such stacks by the respective expelling devices 14 and 16. The clamping means 12 for the stack 3 on the conveyor 2 comprises a vertically reciprocable plunger or ram 18 which is movable up and down by a rod 19 connected to a lever 22 which is pivotable by a double-acting fluid operated motor 21 mounted on an elongated carrier 13 in the form of an overhead rail secured to and movable with the platforms of the conveyors 1 and 2. The clamping means 11 for the stack 3 on the conveyor 1 is a mirror image of the clamping means 12 and is also mounted on the carrier 13 so that it participates in all movements of the corresponding conveyor 2 between the positions B and C.

The air expelling device 16 is mounted on a stationary supporting member 17 of the frame and comprises a vertically reciprocable roller-shaped squeegee 23 movable up and down by a rod 19*a* which is attached to a lever 22*a* pivotable by a double-acting fluid-operated motor 21*a*. The air expelling device 16 is a mirror image of the air expelling device 14.

The air expelling device 14 is located to the left of the clamping means 11 and its squeegee 23 is closely adjacent the ram 18 of the clamping means 11 when the conveyor 1 assumes the position A. The ram 18 of the air expelling device 14 is disposed adjacent the rightmost portion of the stack 3 on the conveyor 1 and compresses such portion of the stack 3 when the motor 21 of the clamping means 11 is actuated to pivot the respective lever 22 in a counterclockwise direction as seen in FIG. 1. This entails automatic expulsion of air from the corresponding portion of the stack 3 on the conveyor 1. When the conveyor 1 is thereupon set in motion, the squeegee 23 of the air expelling device 14 is held in its operative position on the topmost sheet of the stack 3 on the conveyor 1 so that this squeegee expels air (if any) from successive increments of the stack 3 and the expulsion of air is completed not later than when the conveyor 1 reaches the position B. During travel of the conveyor 1 from the position A to the position B, the ram 18 of the clamping means 12 is held in its raised (inoperative) position so as to ensure that the conveyor 2 can receive a fresh stack 3 not later than when it comes to a halt in the position C. The ram 18 of the clamping means 12 then descends, and the squeegee 23 of the air expelling device 16 also descends to ensure that the freshly delivered stack 3 on the conveyor 2 is relieved of air not later than when the conveyor 2 reaches the position B.

Each ram 18 is preferably designed to bear upon the entire leading portion of the stack 3 on the respective conveyor. The same applies for the squeegees 23 each of which engages the adjacent stack 3 all the way from one marginal portion to the opposite marginal portion of the topmost sheet of such stack (note FIG. 2 which shows the squeegee 23 of the air expelling device 14). FIG. 2 further shows that the end portions of the illustrated squeegee 23 are mounted at the lower ends of two discrete bars or rods 19*a* each of which is coupled to a discrete lever 22*a* (not shown in FIG. 2). Each such lever is pivotable by a discrete double-acting fluid-operated motor 21*a*. Analogously, each of the elongated rams 18 is mounted on two spaced-apart rods or bars whose upper end portions are articulately connected with discrete levers 22 (not shown in FIG. 2) pivotable by discrete motors 22. Such mounting of the rams 18 and squeegees 23 ensures an even more predictable expulsion of air from the stacks 3 on the conveyors 1 and 2.

In order to enhance the versatility of the apparatus, the latter further comprises means for adjusting the clamping means 11 in the directions of movement (note the arrow 28) of the conveyors 1 and 2 along their path, and means for adjusting the air expelling device 14 relative to such path so that the apparatus can ensure reliable expulsion of air from stacks 3 which are assembled of large, medium sized or small sheets. The left-hand portion of FIG. 1 shows that the conveyor 1 can support a stack which is assembled of sheets having a width a or a width b (as measured in the direction of reciprocatory movement of the conveyor 1). Regardless of the size of its sheets, each stack 3 which is deposited on or shifted onto the conveyor 1 is positioned in such a way that its left-hand edge face 24 is located at a predetermined distance (c) from the left-hand end portion of the conveyor 1. If the conveyor 1 is to receive and transport stacks 3 which are composed of overlapping sheets having a width a, the clamping device 11 is moved to the phantom-line position of FIG. 1 and the air expelling device 14 is moved to the phantom-line position to the left of the ram 18 of the adjusted clamping device 11. The means 26 for adjusting the casing or housing of the clamping device 11 relative to the carrier 13 comprises a suitable transmission, e.g., a rack-and-pinion drive 26*a*, 26*b* whose rack is affixed to the carrier 13 and whose pinion can be driven (clockwise or counterclockwise) by a suitable motor (not shown) in response to signals from a sensor (not shown) serving as a means for ascertaining the width (a or b) of sheets which form the stack 3 on the conveyor 1. The means 27 for adjusting the air expelling device 14 (so as to assume a proper position with reference to the adjusted clamping means 11) comprises a rack-and-pinion drive 27*a*, 27*b* whose rack is mounted on the supporting means 17 and whose pinion 27*b* can be rotated (clockwise or counterclockwise) by a suitable motor which receives signals from the aforementioned sensor or from a discrete sensor.

If a relatively narrow stack 3 (consisting of sheets each having a width a) or a series of such stacks is followed by a stack consisting of sheets having a width b, the adjusting means 26 and 27 are actuated to move the clamping means 11 and the air expelling device 14 to the solid-line positions of FIG. 1.

The positions of the clamping means 12 and air expelling device 16 need not be changed even if the dimensions of sheets which form the stacks on the conveyor 2 are changed. Nevertheless, the apparatus can be used to transport stacks 3 with sheets having a first width from the position A to the position B and to transport stacks 3 having sheets of a different second width from the position C to the position B. The position of the clamping means 12 with reference to the conveyor 2 and the position of the air expelling device 16 with reference to the supporting means 17 need not be changed because they are active while the conveyor 2 advances in a direction from the right to the left as seen in FIG. 1 provided, of course, that each stack which is deposited on the conveyor 2 (regardless of the width of sheets which form the stack) is placed onto the conveyor 2 at a predetermined distance from the left-hand side of such conveyor.

Referring again to FIG. 2, it will be seen that the supporting means 17 comprises two spaced-apart parallel horizontal supporting members and that the carrier 13 also comprises two spaced-apart horizontal carriers each of which shares all movements of the conveyors 1, 2 in the directions indicated by the arrow 6. The supporting members are mounted on upright frame members 31 at opposite sides of the path of movement of the conveyors 1 and 2, and the carriers are mounted on upright frame members 29. All of the frame members 29, 31 are mounted on the frame 8, 9 in such a way that they do not interfere with movements of the conveyors 1, 2 and/or clamping means 11, 12, with the delivery of stacks 3 onto the conveyors 1, 2 and/or with the removal of stacks from the conveyors 1, 2.

The squeegees 23 are preferably rotatable about their respective horizontal axes 32. However, such rotary squeegees can be replaced by or used jointly with other types of air expelling elements, e.g., in the form of skids, runners or the like.

The mode of operation of the apparatus of FIGS. 1 and 2 is as follows:

The conveyors 1 and 2 are assumed to occupy the positions A and B of FIG. 1. The conveyor 1 has received a fresh stack 3 of sheets from a supplying conveyor in front of the plane of FIG. 1, and the conveyor 2 is in the process of being relieved of its stack 3 which is transferred onto a receiving conveyor located behind the plane of FIG. 1. The stack 3 on the conveyor 1 contains (or can contain) pockets of air which is entrapped between its sheets. The stack 3 on the conveyor 2 has already advanced past the air expelling device 16 and is assumed to be devoid of entrapped air or to contain negligible quantities of entrapped air.

The conveyors 1 and 2 are then set in motion (so that they respectively occupy the positions B and C) after the ram 18 of the clamping means 11 is lowered onto the rightmost portion of the stack 3 on the conveyor 1 and after the squeegee 23 of the air expelling device 14 is lowered to engage the topmost sheet of the stack 3 on the conveyor 1 immediately or closely behind the ram 18 of the clamping means 11. The ram 18 of the clamping means 11 then cooperates with the platform of the conveyor 1 to clamp the leftmost portion of the stack 3 on the conveyor 1 so that such portion of the stack is devoid of air even before the conveyors 1 and 2 are set in motion. The clamping means 11 shares the movement of the conveyor 1 from the position A to the position B to thus ensure that the squeegee 23 of the air expelling device 14 (which does not move with the conveyors) cannot displace one or more sheets at the top of the stack 3 on the conveyor 1 while the latter advances below the device 14 and toward the position B. The air expelling device 14 performs its function in automatic response to movement of the conveyor 1 from the position A to the position B so that the stack 3 on the conveyor 1 is ready to be transferred onto the receiving conveyor as soon as it reaches the position B.

The ram 18 of the clamping means 12 and the squeegee 23 of the air expelling device 16 are held in their raised positions while the conveyor 2 moves from the position B to the position C. The ram 18 of the clamping means 11 is thereupon raised with the squeegee 23 of the air expelling device 14, and the ram 18 of the clamping means 12 is lowered with the squeegee 23 of the air expelling device 16 after the conveyor 2 receives a fresh stack 3 from the adjacent supplying conveyor and before the conveyors 1 and 2 are set in motion to reassume the solid-line positions of FIG. 1. This results in automatic expulsion of air from the stack 3 which is supported by the platform of the conveyor 2.

An important advantage of the improved apparatus is that the expulsion of air from the stacks 3 takes place automatically as an adjunct to transport of the stacks from supplying conveyors to the receiving conveyor. Another important advantage of the improved apparatus is that the means for automatically lifting or lowering the rams 18 and the squeegees 23 in response to movements of the conveyors 1 and 2 along their common path can comprise a small number of extremely simple parts of any known design, e.g., limit switches, sensors and/or others which transmit signals to the controls for the motors 21 and 21*a*.

The feature that the squeegees 23 can be moved up and down by means (19*a*, 21*a*, 22*a*) which are very similar to, or even identical with, the means (19, 21, 22) for moving the rams 18 contributes to simplicity and lower cost of the apparatus.

Figure 3:
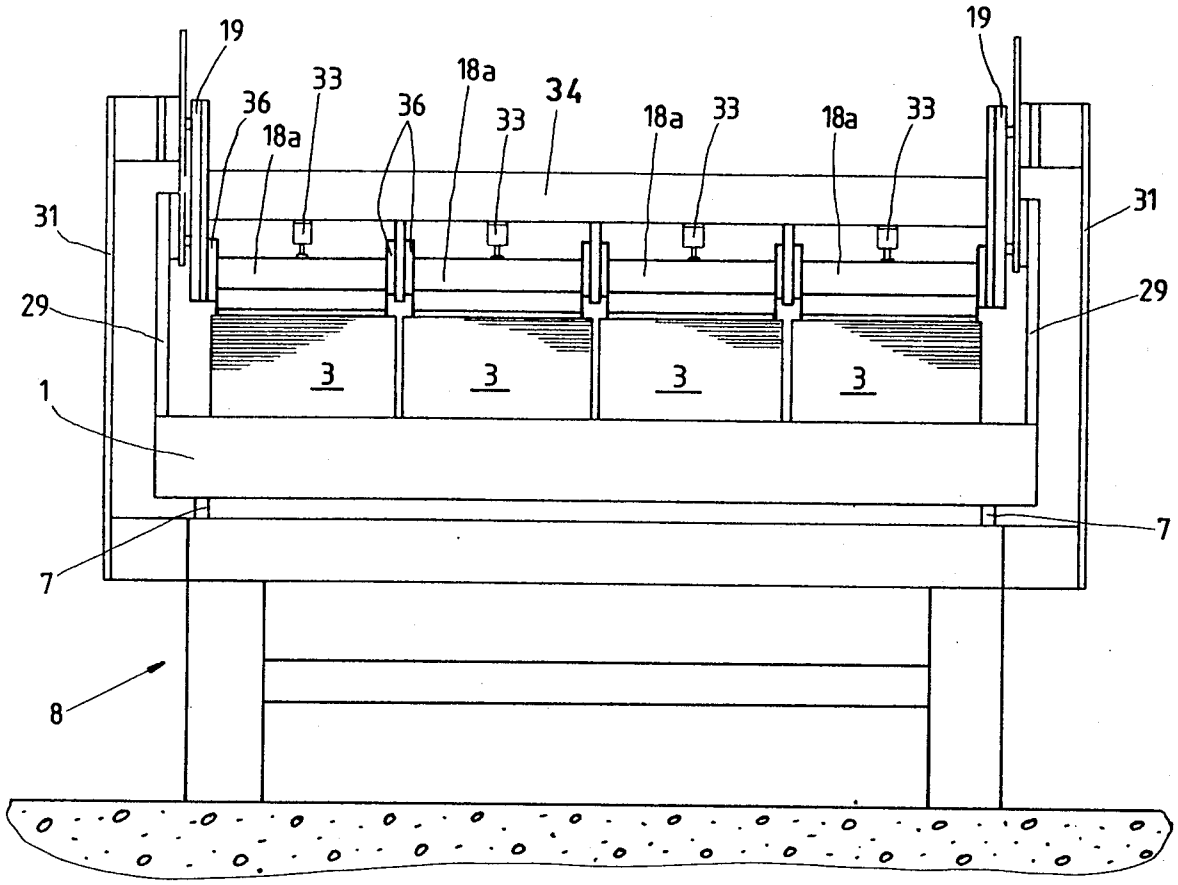
FIG. 3 is a side elevational view of a second apparatus wherein each conveyor can support a series of stacks.
Figure 4:
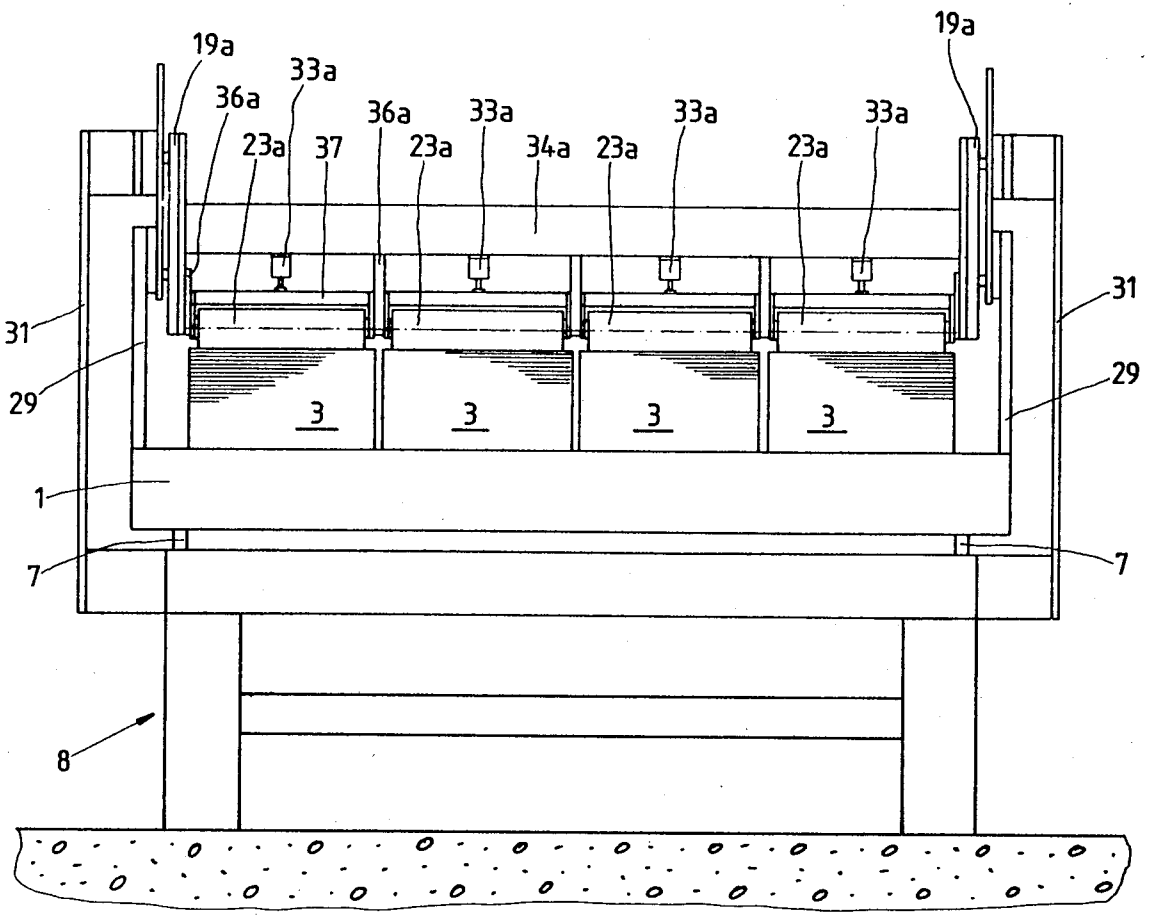
FIG. 4 is a similar side elevational view of the second apparatus, showing the distribution of air expelling devices for a series of stacks.

FIGS. 3 and 4 show portions of a second apparatus which can simultaneously expel air from entire batteries (e.g., rows of four) of stacks 3 on the conveyors 1 and 2 (only the conveyor 1 is shown in FIGS. 3 and 4). The height of each stack 3 can deviate from the height of one or more other stacks, e.g., because certain stacks contain larger quantities of entrapped air and/or contain different numbers of sheets.

The single ram 18 of the clamping means 11 of FIGS. 1 and 2 is replaced by a composite ram having four discrete clamping devices or ram sections 18*a* (see FIG. 3). Analogously, the single squeegee 23 of the air expelling device 14 of FIGS. 1 and 2 is replaced by four discrete expelling elements or squeegees 23*a* (FIG. 4). Each of the ram sections 18*a* and each of the squeegees 23 is disposed above and in register with a discrete stack 3 on the conveyor 1. The ram sections 18*a* are movable up and down relative to each other (at least within certain limits) and are individually biased downwardly toward the topmost sheets of the respective stacks 3 by discrete resilient elements 33 (e.g., coil springs or packages of dished springs) which react against a carrier 34 replacing the carrier 13 of FIGS. 1 and 2. The carrier 34 is movable up and down by a pair of substantially vertically movable rods or bars 19 receiving motion from discrete levers 22 (not specifically shown in FIG. 3) which are pivotable by discrete motors 21 (not shown). In order to ensure that the ram sections 18*a* can move up and down realtive to each other, the ends of each such ram section are vertically movably mounted in upright guides 36 which extend downwardly from and can be fixedly secured to the common carrier 34. The resilient elements 33 yield to an extent which is necessary to ensure adequate compression of the respective stacks 3 regardless of whether or not the heights of the stacks deviate from a standard height and from each other.

The squeegees 23*a* are mounted in discrete frames 37 (FIG. 4) which are movable up and down in discrete guides 36*a* extending downwardly from and preferably affixed to a common supporting means 34*a*. Packages of dished springs, coil springs or other suitable resilient elements 33*a* are interposed between the frames 37 and the supporting means 34*a* to ensure that each of the squeegees 23*a* can properly bear against the upper side of the topmost sheet of the respective stack 3 regardless of differences (if any) between such heights and deviations of one or more heights from a standard or optimum height.

The supporting means 34*a* for all of the squeegees 23*a* can be raised and lowered by substantially vertical rods or bars 19*a* attached to discrete levers 22*a* (not shown) which are pivotable by discrete motors 21*a* (not shown).

FIGS. 3 and 4 merely show one of the clamping means and one of the air expelling devices. The clamping means which cooperates with and shares the movements of the other conveyor can be a mirror image of the clamping means of FIG. 3, and the air expelling device which cooperates with the other conveyor can be a mirror image of the air expelling device which is shown in FIG. 4.

The rows of stacks 3 which are shown in FIGS. 3 and 4 extend at right angles to the longitudinal direction of the path along which the conveyor 1 is movable with the other conveyor to advance such stacks past the registering squeegees 23*a* while the stacks 3 are engaged by the respective ram sections 18*a*.

The apparatus of FIGS. 3 and 4 can be modified in a number of different ways without departing from the spirit of the invention. For example, each of the ram sections 18*a* and/or each of the squeegees 23*a* can be moved up and down by a discrete motor. Moreover, and as mentioned above, the roller-shaped squeegees 23*a* can be replaced by or can be used in conjunction with skids, runners and/or other suitable air expelling elements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating stacks or analogous accumulations of sheets wherein air is, or is likely to be, entrapped between the sheets, comprising first and second conveyors jointly movable back and forth along a predetermined path between first positions in which the first conveyor is ready to receive at least one stack and the second conveyor is ready to be relieved of one or more stacks, and second positions in which the second conveyor is ready to receive at least one stack and the first conveyor is ready to be relieved of one or more stacks; first and second clamping means for respectively urging portions of stacks against the first and second conveyors during movement of the conveyors from the first and second positions, respectively; and first and second air expelling means adjacent said path and operative to respectively expel air from stacks on said first and second conveyors during movement of said conveyors from said first and second positions, respectively, said first and second expelling means being respectively located behind said first and second clamping means as considered in the directions of movement of said conveyors from said first and second positions, respectively.

2. The apparatus of claim 1, wherein said first and second clamping means are movable with said conveyors and respectively comprise means for clamping a portion of the stack on said first conveyor at a location nearest to the second conveyor and for clamping a portion of a stack on said second conveyor at a location nearest to said first conveyor.

3. The apparatus of claim 1, further comprising a frame, said conveyors and said clamping means being movable with reference to said frame and said expelling means being affixed to said frame during movement of said conveyors.

4. The apparatus of claim 1, further comprising carrier means arranged to share the movements of said conveyors, said clamping means being mounted on said carrier means.

5. The apparatus of claim 1, further comprising stationary supporting means for said air expelling means.

6. The apparatus of claim 1, further comprising first adjusting means for changing the position of at least one of said clamping means relative to the respective conveyor in the direction of movement of said conveyors along said path, and second adjusting means for changing the position of at least one of said expelling means with reference to said path.

7. The apparatus of claim 6, wherein at least one of said adjusting means comprises a transmission.

8. The apparatus of claim 6, wherein at least one of said adjusting means comprises a rack-and-pinion drive.

9. The apparatus of claim 1, wherein at least one of said clamping means comprises a ram and means for moving the ram relative to the stack on the respective conveyor.

10. The apparatus of claim 1, wherein at least one of said expelling means comprises a squeegee and means for moving the squeegee relative to the stack on the respective conveyor.

11. The apparatus of claim 1, wherein at least said first conveyor is arranged to carry a series of stacks which are disposed one behind the other transversely of the direction of movement of said conveyors from said first position, said first clamping means comprising a discrete clamping device for each of said series of stacks and said first expelling means comprising a discrete air expelling device for each of said series of stacks.

12. The apparatus of claim 11, wherein said first clamping means comprises common carrier means for said clamping devices and resilient means interposed between said carrier means and each of said clamping devices, said carrier means being arranged to share the movements of said first conveyor.

13. The apparatus of claim 11, wherein said first expelling means comprises stationary supporting means for said expelling devices and resilient means interposed between said supporting means and each of said expelling devices.

* * * * *